US008894471B2

(12) United States Patent
Batard et al.

(10) Patent No.: US 8,894,471 B2
(45) Date of Patent: Nov. 25, 2014

(54) OPTICAL QUALITY SURFACING TOOL

(75) Inventors: Alain Batard, Charenton-le-Pont (FR); Jean-Etienne Lepage, Charenton-le-Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 204 days.

(21) Appl. No.: 13/510,198

(22) PCT Filed: Nov. 30, 2010

(86) PCT No.: PCT/FR2010/052574

§ 371 (c)(1), (2), (4) Date: May 16, 2012

(87) PCT Pub. No.: WO2011/070267

PCT Pub. Date: Jun. 16, 2011

(65) Prior Publication Data

US 2012/0231713 A1 Sep. 13, 2012

(30) Foreign Application Priority Data

Dec. 8, 2009 (FR) ..... 09 58768

(51) Int. Cl.

*B24B 13/00* (2006.01)
*B24D 9/08* (2006.01)
*B24B 13/02* (2006.01)

(52) U.S. Cl.

CPC . *B24D 9/08* (2013.01); *B24B 13/00* (2013.01); *B24B 13/02* (2013.01); *Y10S 451/921* (2013.01)
USPC ..... 451/512; 451/921; 451/548

(58) Field of Classification Search

CPC ..... B24B 13/00–13/02
USPC ..... 451/548, 512, 921, 41–44
See application file for complete search history.

(56) References Cited

U.S. PATENT DOCUMENTS

| | | | | |
|---|---|---|---|---|
| 1,665,292 | A * | 4/1928 | Anderson et al. | 15/230.18 |
| 1,701,669 | A * | 2/1929 | Favre | 451/342 |
| 2005/0101235 | A1 | 5/2005 | Huguet | |
| 2006/0154581 | A1 | 7/2006 | Bernard et al. | |
| 2006/0211353 | A1 * | 9/2006 | Kodani et al. | 451/548 |
| 2008/0171502 | A1 | 7/2008 | Stephane et al. | |
| 2011/0136415 | A1 | 6/2011 | Batard et al. | |

FOREIGN PATENT DOCUMENTS

| | | | |
|---|---|---|---|
| FR | 2 834 662 | A1 | 7/2003 |
| FR | 2 857 610 | A1 | 1/2005 |
| FR | 2 900 356 | A1 | 11/2007 |
| FR | 2 935 628 | A1 | 3/2010 |

OTHER PUBLICATIONS

International Search Report, dated Mar. 24, 2011, from corresponding PCT application.

* cited by examiner

*Primary Examiner* — Monica Carter
*Assistant Examiner* — Marcel Dion
(74) *Attorney, Agent, or Firm* — Young & Thompson

(57) ABSTRACT

An optical-grade surfacing tool (101) is provided with a resilient return element (115) including a plurality of resiliently flexible strips (118) that transversely project from a rigid central mounting (104), each strip (118) having a distal portion (144) that engages by bearing directly upon a petal (134) of a flexible flange (131) that surrounds the rigid mounting (104). The distal portion is curved along a round loop such that the end (145) of each the strip (118) is rotated toward the rigid mounting (104).

19 Claims, 5 Drawing Sheets

OPTICAL QUALITY SURFACING TOOL

FIELD OF THE INVENTION

The invention relates to optical quality surfacing, for surfaces such as a face of an ophthalmic lens or lens of a camera or instrument adapted for the observation of remote objects or such as a face of a semiconductor substrate.

By surfacing is meant any step aiming to modify the state of a surface that has already been formed. It refers in particular to steps of polishing, grinding, or frosting aiming to modify (reduce or increase) the roughness of the surface and/or to reduce the unevenness thereof.

TECHNOLOGICAL BACKGROUND

Already known, in particular from French patent application 2 834 662 to which corresponds the U.S. patent application 2005/0101235, from French patent application 2 857 610 to which corresponds to the U.S. patent application 2006/0154581 and from French patent application 2 900 356 to which corresponds the U.S. patent 2008/0171502, is a tool for surfacing an optical surface, comprising: a rigid support having a transverse end surface; an elastically compressible interface connected to the rigid support, comprising a part referred to as central which is located in line with said end surface of the rigid support and a part referred to as peripheral which is located transversely beyond said end surface of the rigid support; a flexible buffer adapted to be applied against a surface to work, connected to the interface on the opposite side to the rigid support, comprising a part referred to as central which is located in line with said end surface of the rigid support and a part referred to as peripheral which is located transversely beyond said end surface of the rigid support; as well as elastic return means disposed between said rigid support and the peripheral part of said interface, the combination of said peripheral part of the buffer, of said peripheral part of the interface and of the elastic return means forming a means for stabilizing the tool during the surfacing, said tool being adapted to perform surfacing for the most part at the central part of the buffer.

To reduce the roughness of the optical surface, the tool is brought into contact therewith by maintaining a sufficient tool pressure thereon for the buffer to conform to the optical surface, by deformation of the interface.

While irrigating the optical surface with a fluid, it is rotationally driven relative to the tool or (vice-versa) and is swept using that tool.

Generally, the optical surface is rotationally driven, its rubbing against the tool being sufficient to rotationally drive the tool conjointly.

The surfacing step requires an abrasive which may be contained in the buffer or in the fluid.

During the surfacing, the elastically compressible interface makes it possible to compensate for the difference in curvature between the end surface of the support for the tool and the optical surface.

An example embodiment of the tool proposed by French patent application 2 834 662, to which corresponds U.S. patent application 2005/0101235, is described below with reference to FIGS. 1 to 3 of the accompanying drawings, in which FIG. 1 is an exploded perspective view of that tool and an ophthalmic lens having an optical surface to be surfaced;

FIG. 2 is a cross-section view of that tool when assembled, during the surfacing of the optical surface of the lens of FIG. 1; and FIG. 3 is a diagrammatic view from above representing that ophthalmic lens during surfacing using that tool, which tool is represented during the sweeping of the optical surface in two positions one of which is illustrated in dashed line.

In FIG. 1 there is represented a tool 1 for the surfacing of an optical surface 2, in this case one of the faces of an ophthalmic lens 3. In FIG. 1, as in FIG. 2, the optical surface 2 concerned is represented as being concave, but it could equally well be convex.

The tool 1 is formed by the stacking of at least three parts, i.e. a rigid part 4, an elastically compressible part 5, and a flexible part 6, which, in what is to follow, will respectively be called support, interface and buffer.

As can be seen in particular in FIG. 1, the support 4 comprises two jaws, i.e. a lower jaw 7 and an upper jaw 8 which are adapted to be superposed while fitting into each other via a pin 9 projecting from one face 10 of the faces of the upper jaw 8 and adapted to be received in a complementary hole 11 formed, facing it, in a face 12 of the lower jaw 7.

As may be seen in FIG. 1, the support 4 is of cylindrical general shape with rotational symmetry and has an axis of symmetry denoted X, which defines direction referred to as longitudinal.

The normal to the optical surface 2 at the point of intersection of the axis of symmetry X of the tool 1 with the latter is denoted n.

The lower jaw 7 has, remote from its face 12 in which the hole 11 is made, a substantially transversely extending end surface 13, against which is applied the interface 5, covering it.

The buffer 6 is applied against the interface 5 from the other side thereof relative to the support 4.

To be more precise, the buffer 6 at least in part covers the interface 5 on the opposite side to and in line with the end surface 13.

The rubbing of the buffer 6 against the optical surface 2 will, by means of an abrasive contained in the irrigating fluid or incorporated in the buffer 6 itself, provide superficial removal of material from the optical surface 2 for modification of the surface state, as will be seen below.

The buffer comprises a central part **6*a* which is located in line with the end surface 13, and comprises a peripheral part 14 which is located transversely beyond the end surface 13**.

This peripheral part 14 is connected to the support 4 via elastic return means 15.

The peripheral part 14 extends in continuity with the central part **6*a*** while being, at rest, substantially coplanar therewith.

In the example illustrated in FIGS. 1 and 2, the buffer 6 is in one piece, the peripheral part 14 being connected to the central part **6*a*** such that they in fact form a single component.

In an embodiment represented in thick line in FIG. 1, the buffer 6 has the form of a flower, and thus comprises a plurality of petals **14*b* which, projecting transversely from the central part 6*a*, form the peripheral part 14 of the buffer 6 and which each extends transversely beyond the end surface 13**.

In a variant represented in chain line in FIG. 1, the peripheral part 14 takes the form of a crown **14*a* which surrounds the central part 6*a***

In this case, in the absence of stress, and when it is in one piece, the buffer 6 takes the form of a disk of material of small thickness compared with its diameter, as represented in FIG. 1, the peripheral part 14, **14*a* thereby forming a collar with respect to the end surface 13**.

The return means 15, which will be described later, may be directly interposed between the support 4 and the peripheral part 14 of the buffer 6, that is to say, in practice, the collar 14*a* or the petals 14*b*

The interface 5 comprises not only a central part 5*a* which is located in line with the end surface 13, but also a peripheral part 16 which is located transversely beyond the end surface 13.

This peripheral part 16 follows on from the central part 5*a*, and, for example, in the absence of stress, takes the form of a crown which surrounds the central part 5*a*, and which is in fact interposed between the peripheral part 14 of the buffer 6 and the return means 15.

As can be seen in FIGS. 1 and 2, the interface 5 is in one piece, its central part 5*a* and peripheral part 16 in fact being connected to form together a single component, the peripheral part 16 forming a collar with respect to the end surface 13.

Thus, in the absence of stress, the one-piece interface 5 takes for example the form of a disk of material of small thickness compared with its transverse dimension (that is to say its diameter).

When the interface 5 and the buffer 6 are both one-piece components, they have comparable transverse dimensions. In particular, when they each take the form of a disk of material, for convenience of manufacture they will preferably be chosen of the same diameter. However, it is equally possible to use a buffer having a diameter different from that of the interface, in particular a greater diameter in order to attenuate the edge effects of the tool on the worked surface.

Moreover, for reasons which will become apparent hereinafter, a deformable ring 17 is provided interposed between the peripheral part 16 of the interface 5 and the return means 15.

In practice, that ring 17 is fastened to the peripheral part 16 on the other side thereof to the buffer 6, i.e. on the same side as the support 4, so that the latter is surrounded by the ring 17.

The ring 17 is preferably of circular longitudinal section, but could equally be of a section of more complex shape, in particular oblong, polygonal, rectangular or square. Moreover, it is placed on the peripheral part 16 concentrically with the support 4.

The return means 15 are described next.

They comprise at least one elastically flexible strip 18 which projects transversely from the support 4, is connected rigidly to the support 4 at a first end 18*a*, and is connected to the peripheral part 14 of the buffer 6 by a second end 18*b*, referred to as free end, which is an opposite end to the first end 18*a*.

In this way, under the effect of a force exerted longitudinally on the peripheral part 14 opposite that strip 18, the latter deforms while exerting on the peripheral part 14 an opposite reaction to said force.

In practice, the return means 15 comprise a plurality of such strips 18, distributed uniformly around the periphery of the support 4, to act on the whole of the peripheral part 14 of the buffer 6.

The return means 15 in fact take the form of a star-shaped part 19 rigidly fastened to the support 4.

This star-shaped component 19 has a central part 20 from which project a plurality of branches 18 each forming an elastically flexible strip extending radially in a transverse plane.

To fasten the star-shaped component 19 to the support 4, its central part 20 is, in practice, clamped between the jaws 7, 8 of the support 4, its centering being provided by means of a hole 21 through its center through which the pin 9 on the top jaw 8 passes, the assembly being held by fastening means such as screws which, passing through the top jaw 8 and the central part 20 of the star-shaped component 19, engage in the lower jaw 7.

When, in a previously described embodiment, the one-piece buffer 6 comprises a plurality of petals 14*b*, the same number of branches 18 are provided on the star-shaped component 19 as there are petals 14*b*, the star-shaped component 19 being oriented so that each branch 18 is in line with a petal 14*b*. Accordingly, if the buffer 6 comprises seven petals 14*b*, the star-shaped component 19 comprises seven branches 18, each able to provide the elastic return for one petal 14*b*.

The ring 17 is fastened to the interface 5, it being possible for this fastening to be provided by any means, bonding being however preferred, in particular on account of its simplicity.

In the embodiment represented, the diameters of the interface 5, of the buffer 6 and of the star-shaped component 19 are at least twice that of the diameter of the support 4.

Moreover, in the case of surfacing an ophthalmic lens, the diameters of the interface 5 and the buffer 6 are chosen to be substantially equal to the diameter of the lens 3, so that the diameter of the support 4 is considerably less than the diameter of the lens 3.

The use of the tool 1 is illustrated in FIGS. 2 and 3.

In this case this is for surfacing or grinding an aspheric convex face 2 of an ophthalmic lens.

The lens 3 is mounted on a rotary support (not shown) by means of which it is rotationally driven about a fixed axis Y.

The tool 1 is applied against the face 2 with a sufficient force for the buffer 6 to conform to its shape. Here the tool 1 is free to rotate while nevertheless being off-center compared to the optical surface 2. Forced rotational driving of the tool, by means provided for that purpose, may however be provided.

The relative rubbing between the optical surface 2 and the buffer 6 is sufficient to rotationally drive the tool 1 in the same direction as that of the lens 3, about an axis substantially coincident with the axis X of symmetry of the support 4.

The optical surface 2 is irrigated with an irrigation fluid which is abrasive or non-abrasive depending upon whether or not the buffer itself has that function.

To sweep the whole of the optical surface 2, the tool 1 is moved during surfacing along a radial trajectory, the point of intersection of the rotational axis X of the tool 1 with the optical surface 2 moving to and fro between two turn-back points, namely an outer turn-back point A and an inner turn-back point B, both these points being at a distance from the rotational axis Y of the lens 3.

Thanks to the compressibility of the central part 5*a* of the interface 5, the central part 6*a* of the buffer 6 deforms to conform to the shape of the optical surface 2.

Thanks to deformation of the flexible strips 18, the peripheral part 14 of the buffer 6 deforms to conform to the shape of the optical surface 2.

Given the rigidity of the support 4, material is mostly removed in line with the end surface 13, i.e. material is essentially removed by the central part 6*a* of the buffer 6.

The peripheral parts 14 of the buffer 6 and 16 of the interface 5 have an essentially stabilizing role, thanks to the increased lift or seating of the tool 1 relative to a conventional tool whose buffer and interface would be limited to the central parts 5*a*, 6*a*, and also thanks to the return means 15, which maintain permanent contact between the peripheral part 14 of the buffer 6 and the optical surface 2.

The deformable ring 17 enables smoothing of the stress distribution exerted on the peripheral rim of the interface 5 and thus on the buffer 6 by the strips 18.

It follows that, regardless of the location of the tool 1 on the optical surface 2, and regardless of its rotational speed, its rotational axis X is always colinear or substantially colinear with the normal n to the optical surface 2, so that the orientation of the tool 1 is optimized at all times.

In the embodiment illustrated in FIGS. 1 and 2, the end surface 13 of the support 4 is plane.

The tool is thus adapted for surfacing a certain range of optical surfaces 2 with different curvatures.

To modify the adaptability of the tool 1, it is possible to bias the return means 15 by twisting the flexible strips 18 so that they are already flexed at rest, in one direction or the other.

If at rest the strips 18 are straight or flexed away from the end surface 13, the tool 1 is intended for concave optical surfaces 2, whereas if at rest the strips 18 are bent toward the end surface 13, the tool 1 is intended for convex optical surfaces 2.

In a first variant which is not illustrated, the end surface 13 of the support 4 is convex, the tool 1 thus being intended for optical surfaces 2 having a more pronounced concavity.

In a second variant which is not illustrated, the end surface 13 of the support 4 is on the contrary concave, the tool 1 thus being intended for optical surfaces 2 having a more pronounced convexity.

Of course, it is possible to combine the concave or convex embodiment of the end surface 13 with biasing of the return means 15, as described above.

French patent application 2 857 610, to which corresponds U.S. patent application 2006/0154581, proposes that the elastic retain means, rather than being in the form of a star-shaped component such as component 19 illustrated in FIGS. 1 and 2, should have a continuous peripheral part bearingly cooperating with the peripheral part of the buffer such as buffer 6, directly or via only the interface such as interface 5 (no deformable ring such as 17 being provided), the elastic return means comprising, in addition to the continuous peripheral part, a flat or curved collar rigidly fastened, inside, to the support such as support 4, that collar being formed by a pierced or unpierced wall.

The continuous character of the peripheral part of this return means makes it possible to increase the evenness of the surfacing performed by the tool.

French patent application 900 356, to which corresponds U.S. patent application 2008/0171502, proposes that the rigid support should belong to a base comprising a flexible collar surrounding the rigid support with the elastically compressible interface covering an end surface of the collar situated on the same side as the end surface of the rigid support.

By virtue of the collar, the contact area between the interface and the rest of the tool is particularly large, which ensures a uniform distribution of the pressure applied on the surface to work and thereby makes it possible to perform surfacing steps giving a high quality finish.

SUBJECT OF THE INVENTION

The invention aims to provide a surfacing tool providing particularly good performance with regard to minimizing defects of finish.

To that end the invention provides an optical quality surfacing tool, comprising: a base comprising a flexible collar and a rigid support surrounded by said collar, which collar is subdivided into petals, said rigid support having a transverse end surface; an elastically compressible interface connected to the base, comprising a part referred to as central which is located in line with said end surface of the rigid support and a part referred to as peripheral which is located transversely beyond said end surface of the rigid support, said elastically compressible interface being applied against and covering an end surface of said collar situated on the same side as the end surface of the rigid support; a flexible buffer adapted to be applied against a surface to work, connected to the interface on the opposite side to the rigid support, comprising a part referred to as central which is located in line with said end surface of the rigid support and a part referred to as peripheral which is located transversely beyond said end surface of the rigid support; as well as elastic return means disposed between said rigid support and the peripheral part of said interface, the combination of said peripheral part of the buffer, of said peripheral part of the interface and of the elastic return means forming a means for stabilizing the tool during the surfacing, said tool being adapted to perform surfacing for the most part at the central part of the buffer, characterized in that said elastic return means comprise a plurality of elastically flexible strips which project transversely from the rigid support, each strip having a distal portion in direct bearing cooperation with a said petal; said distal portion being curved in a rounded curl such that the end of each said strip is turned towards said rigid support.

The strips and the petals thus cooperate so as to exert a force on the interface which is particularly favorable both with regard to the general form of the tool and with regard to its capacity to deform to follow the variations in altitude of the surface to work, including when it has great variations in altitude as is the case for one of the faces of a spectacles lens provided to correct the version of a presbyopic, myopic and astigmatic wearer.

In particular, the form of the distal portions of the strips provides flexible, progressive and continuous give (damping) with regard to the deformations.

According to preferred features, each elastic strip is an individual strip mounted onto said rigid support.

The assembly of the strips to the rigid support is admittedly more complex than if the strips were to form part of a star-shaped component, but given the existence of the curved distal portion of each strip, the individual or distinct character of the strips is particularly advantageous, on account of the convenience and simplicity of producing the strips that it gives.

According to other preferred features, each elastic strip is permanently mounted onto said rigid support.

Alternatively, according to other preferred features, said rigid support and each elastic strip are arranged in order for each elastic strip to be mounted onto said rigid support in demountable and remountable manner.

Preferably, said rigid support comprises for each strip a cavity having a retaining recess while each strip comprises a U-shaped portion adapted to be accommodated in a said cavity of the support, with one branch of said U-shaped portion comprising a nose adapted to enter said recess.

Preferably, for each strip the tool comprises a wedge of elastically compressible material which forcibly inserts between the branches of the U-shaped portion.

Preferably, each said wedge has a distal portion which is rounded like the base of the U-shaped portion and a proximal portion which has a tab projecting between two shoulders.

Preferably, at the location of the opening of each cavity the tool comprises a rib on the opposite side to that at which said recess is formed.

Preferably, said rib has a central passage for a tab for extracting said strip out of said cavity.

According to other preferred features, there are more said petals than said strips.

Preferably, there are twice as many petals as strips.

According to other preferred features, said end surface of the collar is flush with said end surface of said support.

According to other preferred features, said rigid support comprises a cavity for receiving the head of a surfacing machine arbor.

According to other preferred features, said base is a one-piece plastics molding.

According to other preferred features, each strip is of spring steel.

BRIEF DESCRIPTION OF THE DRAWINGS

The disclosure of the invention will now be continued with the detailed description of embodiments, given below by way of non-limiting example, with reference to FIGS. 4 and following the accompanying drawings. In the drawings.

DETAILED DESCRIPTION OF EMBODIMENTS

Figure 1:
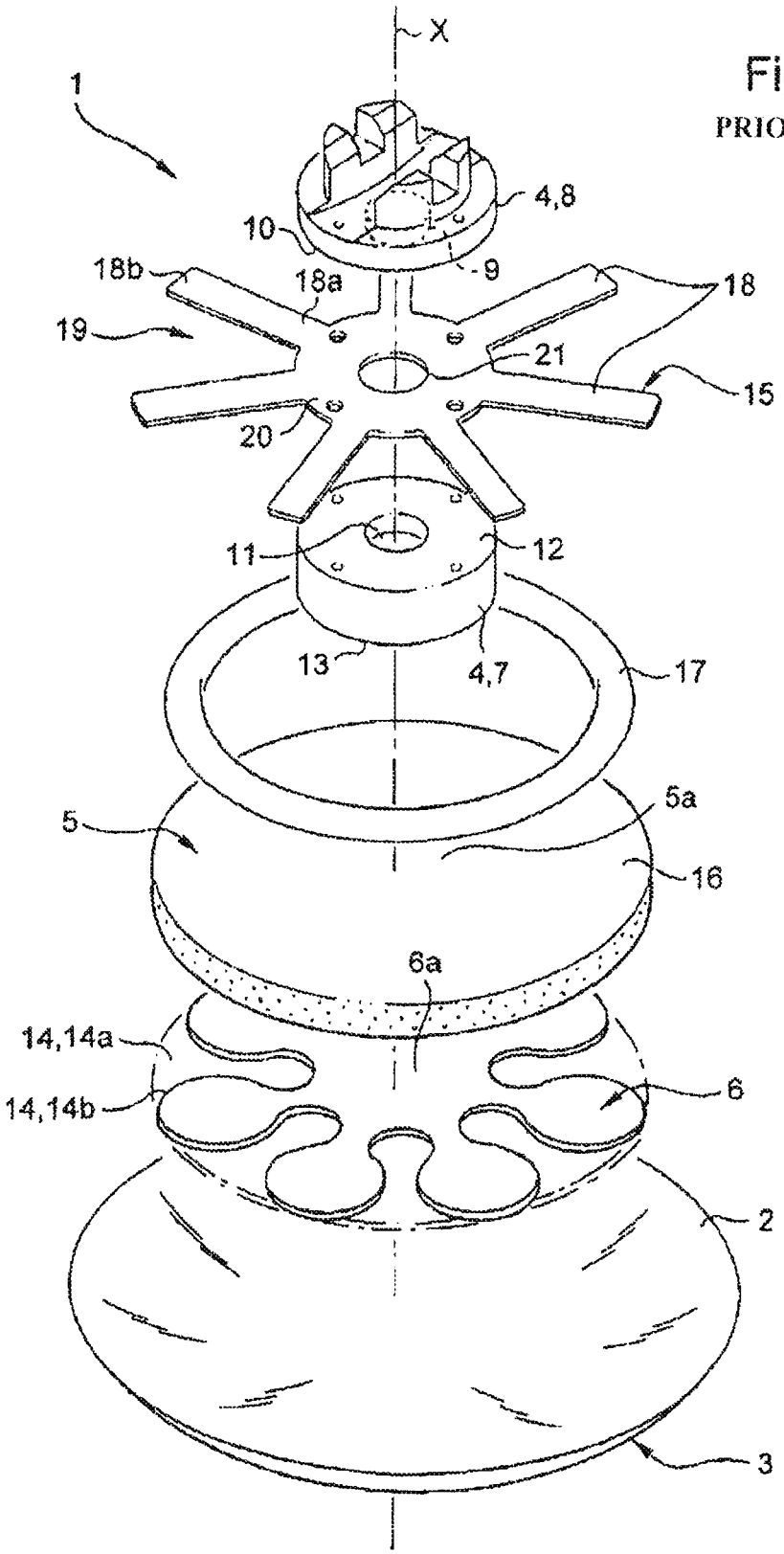
Fig. 1 PRIOR ART
FIG. 1 is an exploded perspective view of that tool and an ophthalmic lens having an optical surface to be surfaced.

In what follows, the same numerical references as for the tool 1 have been used for the tool in accordance with the invention, but increased by 100.

In general terms, the tool 101 is arranged like the tool 1, with:

- a rigid support 104 having a transverse end surface 113;
- an elastically compressible interface 105 (FIG. 6) which is applied against and which covers the end surface 113;
- a flexible buffer 106 (FIG. 6) adapted to be applied against the optical surface such as 2 of a lens such as 3 and which is applied against and which covers at least partly the interface 105 on the opposite side to and in line with the end surface 113, the buffer 106 comprising a central part which is located in line with the end surface 113 and a peripheral part which is located transversely beyond the end surface 113; and
- elastic return means 115, here formed by a set of elastically flexible strips 118, connecting the peripheral part of the buffer 106 to the support 104, the combination of the peripheral part of the buffer 106 and of the return means forming a means for stabilizing the tool 101 during surfacing, the tool 101 being adapted to perform surfacing which is for the most part located at the central portion of the buffer 106.

The support 104 belongs to a base 130 which has a flexible peripheral part 131 located transversely beyond the centrally disposed rigid support 104.

The peripheral part 131 overall forms a flexible collar having an outer diameter (greater diameter) similar to the outer diameter of the interface 105 and of the buffer 106.

The inner diameter (smaller diameter) of the flexible collar 131 corresponds to the outer diameter of the support 104, the collar 131 projecting from the lateral wall of the support 104.

Figure 4:
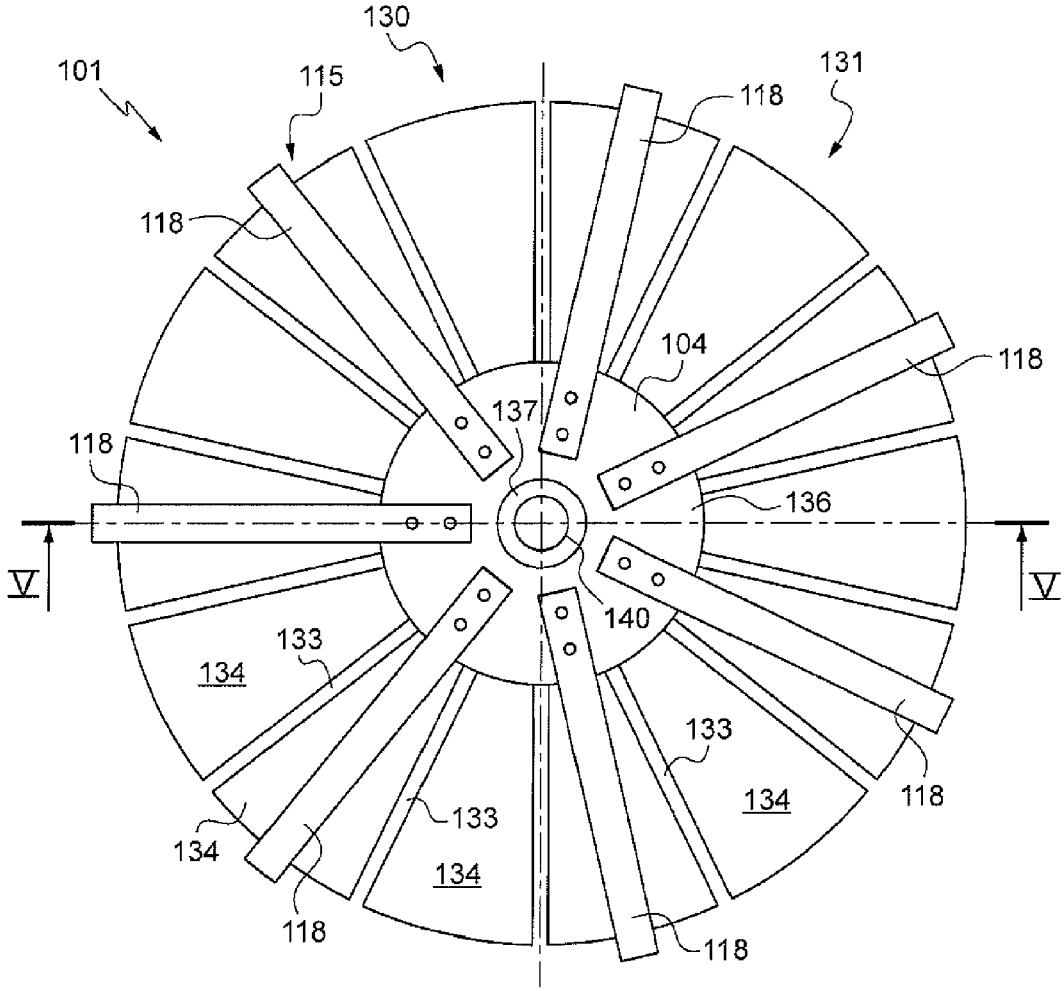
FIG. 4 is a view from above of a part of the tool in accordance with the invention, and more particularly of the base and of the strips.
Figure 5:
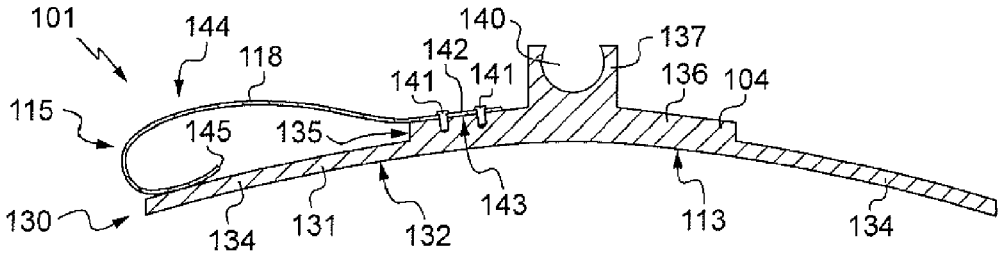
FIG. 5 is the section view in elevation on V-V of FIG. 4.
Figure 6:
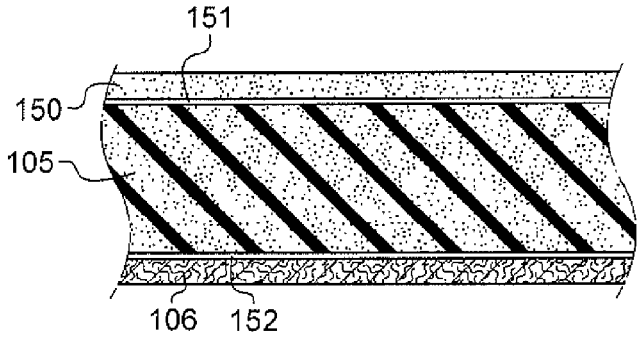
FIG. 6 is a diagrammatic cross-section view of another portion of the tool according to the invention, comprising the elastically compressible interface and the flexible buffer.

In the example illustrated in FIGS. 4 to 6, the support 104 and the flexible peripheral collar 131 are a one-piece plastics molding, the support 104 being massive at least in the neighborhood of the surface 113 in order to have the required rigidity whereas the collar 131 has a small wall thickness in order to be flexible.

In the preferred example illustrated in FIGS. 4 to 6, the collar 131 has fourteen radially oriented slots 133 distributed with equal angular spacing, such that the collar 131 is subdivided into fourteen petals 134 the general form of each of which being that of a truncated angular sector.

The subdivision of the collar 131 into petals enables that collar to be flexible in order to conform to different curves of surfaces to polish.

The end surface 113 of the support 104 is flush with the surface 132 of the collar 131 on the same side.

The fact that the support 104 and the collar 131 are formed from a single piece makes it possible to reduce the edge marking effects of the end surface 113 on the surface to work, such that the tool 101 enables surfacing steps to be carried out with a high quality of aspect.

On account of the difference in thickness between the collar 131 and the support 104, there is a shoulder 135, on the opposite side to the surfaces 132 and 113, at the junction between the collar 131 and the support 104.

Overall, of the support 104 has the outline of a hat with a proximal portion 137 of smaller outer diameter than the distal portion 136 to which the end surface 113 and the shoulder 135 belong.

The proximal portion 137 serves to connect the support 104, and more generally the base 130, to the arbor of the surfacing machine enabling the tool 101 to cooperate with an optical surface such as 2 in the manner explained above with reference to FIGS. 2 and 3.

The proximal portion 137 has a cavity 140 for receiving the arbor head. The general shape of the cavity 140 is that of three-quarters of a sphere.

The arbor head provided for being received in the cavity 140 comprises an end similarly formed in the shape of a portion of a sphere The assembly between the proximal part 137 and the arbor of the machine is made by simple snap engagement, the thickness of the part 137 being sufficiently small.

When the arbor head is engaged in the cavity 140, ball-joint cooperation of the tool 101 relative to the arbor is provided.

It should be noted that the center of the cavity 140 is particularly close to the end surface 113, which enables the tool 101 to orientate itself optimally relative to the surface such as 2 with which the tool 101 has to cooperate.

The elastic return means 115 will now be described in detail.

These comprise a plurality of elastically flexible strips 118, of which there are seven here, distributed with equal angular spacing, which project transversely from the support 104 until they come to bear on the collar flexible 131, on the same side as the portion 137.

In practice, each strip 118 is rigidly connected to the support 104 by screws 141 which press its proximal portion 142, which is flat, onto an annular surface 143 of the support 104 situated between the portion 137 and the shoulder 135.

The strips 118 are angularly disposed in order to for each to be centered relative to the associated petal 134.

It will be noted that the length of the strips 118 is such that they each extend transversely beyond the collar 131.

The strips 118 each have a distal portion 144 curved towards the associated petal 134 in a rounded curl such that the end 145 of the strip 118 is turned towards the support 104, the contact zone between the strip 118 and petal 134 being situated back from the end 145.

Thanks to this conformation, each strip 118 is free to slide on the associated petal 134 when they deform, since it is by a relatively flat zone that each strip 118 is in contact with the associated petal 134, over a relatively flat terminal portion of that petal 134.

It will be noted that if the conformation of the terminal portion 144 had been such that the end 145 was turned towards the strip 118, and thus if it had been by the end 145 that the strip 118 bore on the petal 134, the sliding would occur under less good conditions due to the small zone of contact provided by the end 145.

In practice, here, each strip 118 is first of all inclined away from the associated petal 134 then curves towards the associated petal 134 over approximately one half turn.

It will be noted that, as can be seen in FIG. 5, the contact zone is in the neighborhood of the periphery of the collar 134.

The conformation of the strips 118 and of the petals 134 is such that in the absence of external stress (situation illustrated in FIG. 5) the assembly formed by the surfaces 113 and 132 is concave.

As indicated above, the diameter of the interface 105 and of the buffer 106 corresponds to the outer diameter of the collar 131.

The connection between the interface 105 and the base 130 is formed thanks to a double sided adhesive 150 disposed between the interface 105 and the surfaces 113 and 132 of the base 130.

In the illustrated example, the elastically compressible interface 105 is of foam of thickness of the order of 9 mm with a brilliant skin situated on the same side as the buffer 106.

A polyester (PET) film 151, for example of thickness 23 microns, is heat-welded on the opposite side to the skin, that is to say on the same side as the double sided adhesive 150.

The link between the elastically compressible interface 105 and the flexible buffer 106 is made thanks to a layer 152 of bonding mastic, here a layer 0.5 mm thick.

Still in the example illustrated in FIG. 6, the flexible buffer 106 has a thickness of the order of 1 mm and the double sided adhesive 150 has a thickness of the order of 0.32 mm.

The diameter of the interface 105 and of the buffer 106 is of the order of 55 mm.

The base 130 is a one-piece injection molding of plastics material.

In the example illustrated, the base 130, which must be both rigid in the neighborhood of the end surface 113 and flexible at the collar 131 and at the proximal part 137 to enable the snap engagements, while giving good wear resistance for the cooperation with the arbor head, is of polypropylene (PP) or of high density polyethylene (for example HDPE 1000).

The base thus has good wear resistance for the cooperation with the arbor head and enables easy bonding with the interface 105.

The end surface 113 of the support 104 is shaped as a portion of a sphere having a radius of curvature of the order of 70 mm.

When the base 130 is at rest, that is to say in the absence of external forces, the surface 132 of the collar 131 which, as stated above, is flush with the surface 113, is shaped with the same curvature.

Thanks to the collar 131, the contact area between the interface 105 and the rest of the tool, which is the base 130 in this case, is particularly great since it is formed both by the surface 113 and by the surface 132.

This ensures a uniform distribution of the pressure exerted on the surface to work, such as the surface 2 of the lens 3.

Figure 2:
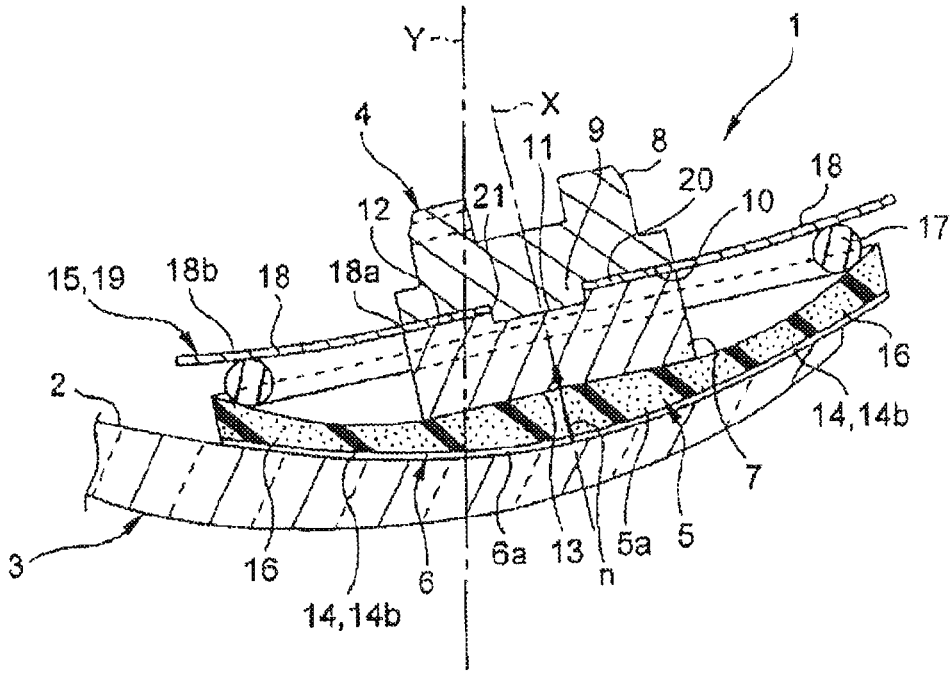
Fig.2 PRIOR ART
FIG. 2 is a cross-section view of that tool when assembled, during the surfacing of the optical surface of the lens of FIG. 1.
Figure 3:
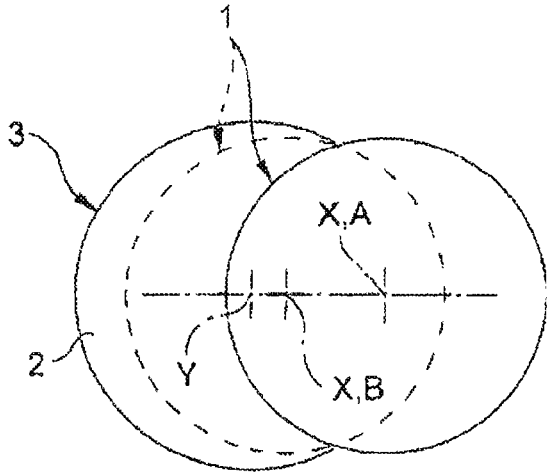
Fig.3 PRIOR ART
FIG. 3 is a diagrammatic view from above representing that ophthalmic lens during surfacing using that tool, which tool is represented during the sweeping of the optical surface in two positions one of which is illustrated in dashed line.

The risk of marking the surface to work by the ridge-shaped edge of the end surface 13, as with the prior tool of FIGS. 1 to 3, is in particular avoided.

This more generally enables the tool 101 to perform surfacing steps having particularly high aspect qualities.

Moreover, the fact of having available both surface 113 and surface 132 facilitates the bonding of the interface 105 with the rigid support 104. When the tool 101 is applied against a convex surface to work such as the surface 2 shown in FIGS. 1 to 3, the elastically compressible interface 105 is strongly compressed at the location of the central part and the force exerted by the strips 118 is useful for forcing the peripheral part of the buffer 106 to remain in contact with the surface such as 2.

During the surfacing, the fact that the strips 118 exert a force on the petals 134 directed towards the interface 105 at the location of the periphery thereof, enables the tool 101 to give particularly good performance in relation to maintaining the contact with the surface to work such as 2, including when the latter has considerable variations in altitude, for example if it is a face of a spectacles lens for correcting the vision of a presbyopic, myopic and astigmatic wearer.

The conformation of the terminal part 144 has the advantage, thanks to its rounded character, of providing flexible, progressive and continuous damping, favorable to the performance of the tool 101.

It will be noted that it would have been possible to form the distal portion 144 not rounded but with a fold which would play the role of a hinge between two flat portions. Such a conformation would give less good performance since with such a hinge, the progressive and continuous character of the damping would be lost.

Figure 7:
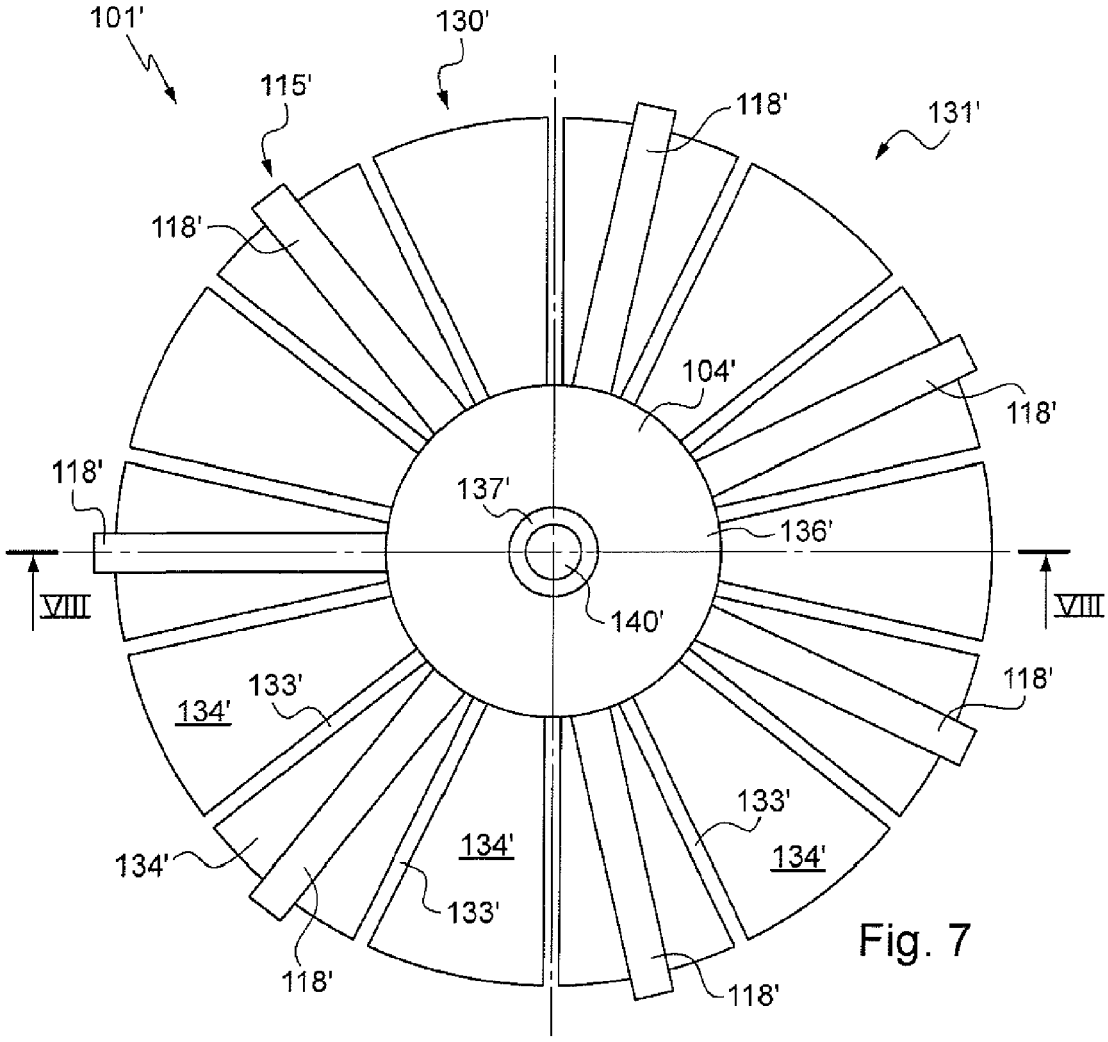
FIGS. 7 and 8 are similar views to FIGS. 4 and 5 showing a variant of the base and of the strips.
Figure 8:
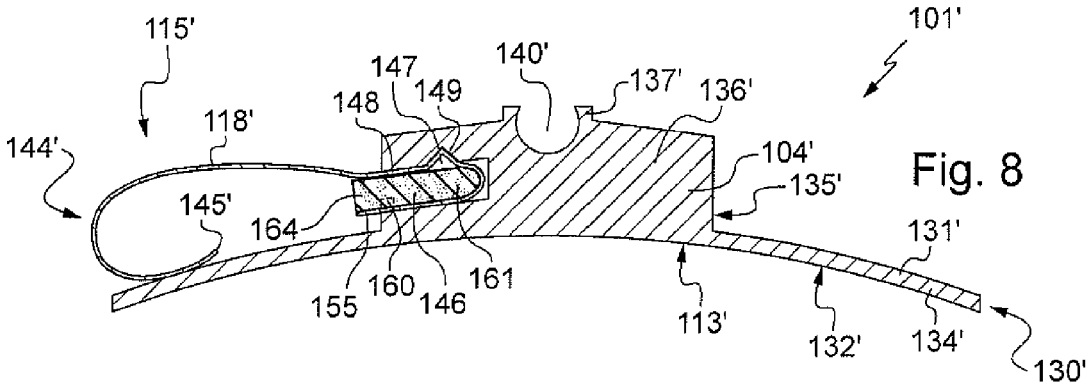

A variant 130' of the base 130 will now be described with reference to FIGS. 7 and 8. The same numerical references have been used for similar parts, but with an exponent symbol '.

The base 130' is arranged like the base 130 but whereas each elastic strip 118 is mounted on permanently to the support 104 (here, the screws 141 cannot be removed), the rigid support 104' and each elastic strip 118' are arranged such that each elastic strip 118' can be mounted on to said rigid support 104' demountably and remountably.

The interchangeable character which the strips then have is particularly advantageous for considerations of maintenance and/or fine adjustments of the behavior of the tool.

In practice, the support 104' comprises for each strip 118' a cavity 146 having a retaining recess 147 while each strip comprises a U-shaped portion 148 adapted to be accommodated in a cavity 146 of the support 104', with one branch of the U-shaped portion 148 comprising a nose 149 adapted to enter the recess 147.

In addition to the recess 147, to retain each strip 118' a rib 160 is provided at the opening of each cavity 146, the rib 160 being on the opposite side to that where the recess 147 is provided.

At its center, the rib 160 has a passage into which comes into place a tab 155 (see especially FIGS. 9 and 10) projecting from the opposite branch 156 of the U-shaped portion 148 to the branch comprising the nose 149.

Figure 10:
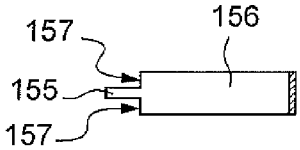
FIG. 10 is the view on X-X of FIG. 9.
Figure 11:
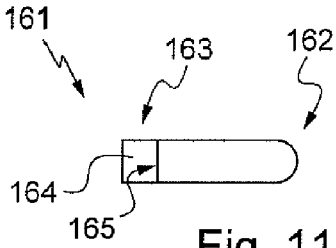
FIGS. 11 and 12, which are enlarged relative to FIG. 8, are views respectively in elevation and in plan view of the holding shim provided for each strip.
Figure 12:
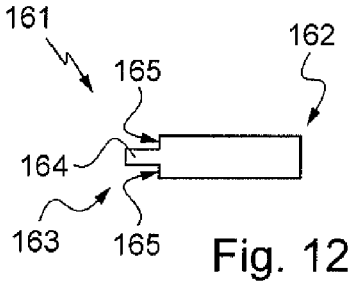

As can be seen in FIG. 10, the tab 155 projects between two shoulders 157 of the portion 156. It is the shoulders 157 which bear on the rib 160. The tab 155 serves to extract the strip 118' from the housing 146.

Figure 9:
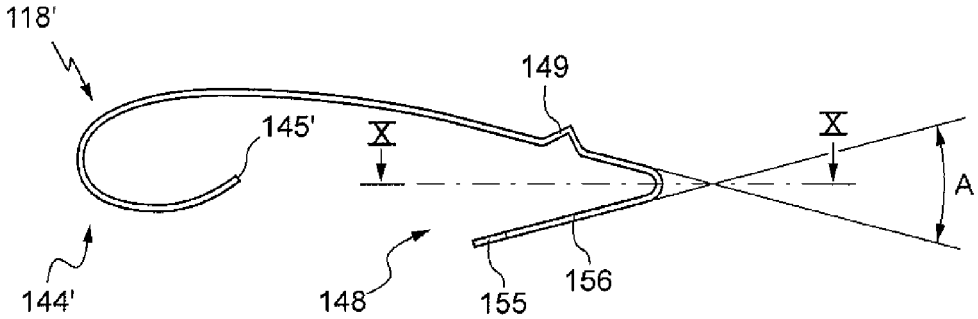
FIG. 9, which is enlarged relative to FIG. 8, is an elevation view of one of the strips comprised by the tool, in the position that it takes at rest, that is to say in the absence of external stresses.

As shown by FIG. 9, it will be noted that at rest (in the absence of external stresses) the U-shaped portion 148 forms an angle at the vertex A which is greater than when the portion 148 is in place in the housing 146.

Still in order to retain each strip 118' in a cavity 146, a wedge 161 of elastically compressible material is also provided here, which forcibly inserts between the branches of the U-shaped portion 148.

The wedge 161 has a distal portion 162 which is rounded like the base of the U-shaped portion 148 and a proximal portion 163 which has a tab 164 projecting between two shoulders 165.

The shoulders 165 serve as a stop against the rib 160. The tab 164 comes into place in the passage of the center of the rib 160. The tab 164 serves to extract the wedge 161.

In the illustrated examples, there are twice the number of petals 134 or 134' as strips 118 or 118' since this provides here an excellent deformation capacity for following a surface such as the surface 2. In variants not illustrated, according to circumstances, there are also a greater number of petals than strips but with a different ratio for example two strips for three petals, or even there are as many petals as strips.

In variants not illustrated of the embodiment with strips that cannot be demounted or which are permanently mounted on the rigid support (embodiment illustrated in FIGS. 4 and 5), the strips are fastened other than by screws, for example by bonding, riveting, overmolding or even thanks to the presence of an overmolded clamping insert.

In variants not illustrated of the embodiment with demountable and remountable strips (embodiment illustrated in FIGS. 7 to 11), the fastening is made with removable screws, the housings for the strips are formed by overmolded inserts (composite base), the support is in two snap-engaged parts, for example with a metal part (part cooperating with the arbor).

In still another variant not illustrated, the elastic return means formed by individual strips are replaced by one or more star-shaped parts.

In variants not illustrated, the base of the tool according to the invention comprises a number of petals different from fourteen, for example six or sixteen and slots delimiting the petals have different shapes, for example with undulations.

In still other variants not illustrated, the conformation of the support 104 is different, for example in two parts forming jaws as in the prior tool illustrated in FIGS. 1 to 3.

In still other variants of the tool according to the invention, the parts other than the base are arranged differently, for example as illustrated in FIGS. 1 to 3.

Numerous other variants are possible according to circumstances, and in this connection it is to be recalled that the invention is not limited to the examples described and represented.

The invention claimed is:

1. An optical quality surfacing tool comprising:

a base including a flexible collar subdivided into petals, and a rigid support surrounded by the collar, the rigid support having a transverse end surface;

an elastically compressible interface connected to the base, the interface including a central part located in line with the end surface of the rigid support and a peripheral part located transversely beyond the end surface of the rigid support, the elastically compressible interface being applied against and covering an end surface of the collar situated on the same side as the end surface of the rigid support;

a flexible buffer configured to be applied against a surface to work, the flexible buffer being connected to the interface on the opposite side to the rigid support, the flexible buffer including a central part located in line with the end surface of the rigid support, and a peripheral part located transversely beyond the end surface of the rigid support; and elastic return means disposed between the rigid support and the peripheral part of the interface, the combination of the peripheral part of the buffer, the peripheral part of the interface and the elastic return means forming a means for stabilizing the tool during the surfacing, the tool being configured to perform surfacing substantially at the central part of the buffer, the elastic return means including a plurality of elastically flexible strips which project transversely from the rigid support, each strip having a distal portion in direct bearing cooperation with one of the petals, the distal portion being curved in a rounded curl such that an end of each strip is turned towards the rigid support.

2. The tool according claim 1, wherein each elastic strip is an individual strip mounted onto the rigid support.

3. The tool according claim 2, wherein each elastic strip is permanently mounted onto the rigid support.

4. The tool according claim 2, wherein the rigid support and each elastic strip are arranged in order for each elastic strip to be mounted onto the rigid support in a demountable and remountable manner.

5. The tool according claim 4, wherein the rigid support includes, for each strip, a cavity having a retaining recess, each strip having a U-shaped portion configured to be accommodated in the cavity of the support, with one branch of the U-shaped portion including a nose configured to enter the recess.

6. The tool according claim 5, further comprising, for each strip, a wedge of elastically compressible material configured to be forcibly inserted between a plurality of branches of the U-shaped portion.

7. The tool according claim 6, wherein each wedge has a distal portion which is rounded similarly to a base of the U-shaped portion, and a proximal portion which has a tab projecting between two shoulders.

8. The tool according to claim 5, further comprising, at an opening of each cavity, a rib on the opposite side to that at which the recess is formed.

9. The tool according claim 8, wherein the rib has a central passage for a tab configured to extract the strip out of the cavity.

10. The tool according to claim 1, wherein the tool includes a greater number of the petals than a number of the strips.

11. The tool according claim 10, wherein the tool includes twice as many petals as strips.

12. The tool according to claim 1, wherein the end surface of the collar is flush with the end surface of the support.

13. The tool according to claim 1, wherein the rigid support includes a cavity configured to receive a head of a surfacing machine arbor.

14. The tool according to claim 1, wherein the base is a one-piece plastics molding.

15. The tool according to claim 1, wherein each strip is made of spring steel.

16. The tool according to claim 6, further comprising, at an opening of each cavity, a rib on the opposite side to that at which the recess is formed.

17. The tool according to claim 7, further comprising, at an opening of each cavity, a rib on the opposite side to that at which the recess is formed.

18. The tool according claim 16, wherein the rib has a central passage for a tab configured to extract the strip out of the cavity.

19. The tool according claim 17, wherein the rib has a central passage for a tab configured to extract the strip out of the cavity.

* * * * *